US008342365B2

(12) United States Patent
Snodgrass

(10) Patent No.: US 8,342,365 B2
(45) Date of Patent: Jan. 1, 2013

(54) TOUCH-FREE PRESSURIZED CAN DISPENSER

(75) Inventor: David L. Snodgrass, Stuart, FL (US)

(73) Assignee: Ultraclenz, LLC, Jupiter, FL (US)

( * ) Notice: Subject to any disclaimer, the term of this patent is extended or adjusted under 35 U.S.C. 154(b) by 640 days.

(21) Appl. No.: 12/480,285

(22) Filed: Jun. 8, 2009

(65) Prior Publication Data

US 2010/0308076 A1 Dec. 9, 2010

(51) Int. Cl.
*B67D 1/00* (2006.01)
*B67B 7/00* (2006.01)
*B65D 83/00* (2006.01)

(52) U.S. Cl. ..... 222/63; 222/52; 222/402.21; 222/504; 222/1

(58) Field of Classification Search ..... 222/52, 222/63, 402.21, 504, 645–649, 1
See application file for complete search history.

(56) References Cited

U.S. PATENT DOCUMENTS

| | | | | |
|---|---|---|---|---|
| 6,293,428 | B1 * | 9/2001 | Chen | 222/55 |
| 6,568,561 | B2 * | 5/2003 | Studer et al. | 222/63 |
| 6,695,246 | B1 * | 2/2004 | Elliott et al. | 242/564.1 |
| 7,281,643 | B2 * | 10/2007 | Lin | 222/214 |
| 7,360,674 | B2 * | 4/2008 | Sassoon | 222/649 |
| 7,540,397 | B2 * | 6/2009 | Muderlak et al. | 222/400.5 |
| 2004/0251271 | A1 * | 12/2004 | Jackson et al. | 222/63 |
| 2005/0247735 | A1 * | 11/2005 | Muderlak et al. | 222/190 |

* cited by examiner

*Primary Examiner* — Kevin P Shaver
*Assistant Examiner* — Nicholas Weiss
(74) *Attorney, Agent, or Firm* — Lucas & Mercanti, LLP; Peter J. Phillips

(57) ABSTRACT

An automatic touch-free dispenser provides dose dispensing of a product from a pressurized can by sensing or detecting the presence of a user's hands, and an actuator assembly which tilts the nozzle on the can in response to such detection, to thereby dispense product from the can. The can may hold a healthcare product, such as a sanitizer, food product, or any other fluid product pressurized in a can. The actuator assembly includes a DC motor which drives a cam, which in turn pushes an actuator lever into the nozzle for a certain dispensing time. The number of doses, detection range, and motor speed, can be adjusted.

14 Claims, 9 Drawing Sheets

TOUCH-FREE PRESSURIZED CAN DISPENSER

BACKGROUND OF THE INVENTION

The present invention relates to a dispenser which automatically, in a "touch-free" manner, dispenses product from pressurized cans, such as lotion, sanitizers, or soaps.

Various arrangements are available for dispensing liquid and/or foam soaps and sanitizers in manual and automatic dispensers. The soap and sanitizers are typically packaged in rigid, semi rigid, collapsible or non collapsible containers or bottles, and flexible containers, such as "bag-in-box" containers.

The pressurized mousse style can is currently prolific in medical settings as a means of dispensing hand sanitizer. This style can would also be useful in food establishments or other manufacturing or food processing establishments where sanitary conditions are important.

Pressurized can products, such as lotions, sanitizer, or soap products, are typically dispensed manually from the can by holding the can in one hand or by attaching the can to the wall with a simple bracket and dispensing the product by tilting the activator spout or nozzle to the side, relative to its normal straight position on the can. The activation requires at least one hand to come in contact with the product container creating possible cross-contamination by different users.

SUMMARY OF THE INVENTION

According to the invention, an automatic or touch-free dispenser is provided for dispensing pressurized product without requiring any physical contact with the product container by hands or otherwise.

As used herein, the term "product" means any fluid, gel, or foam product including, without limitation, liquid soaps and sanitizers, lotion, shampoos, conditioners, body washes, moisturizers, and shaving cream (whether gel, form, or other variety), as well as non-healthcare products, such as food products.

The invention provides a dispenser for automatically dispensing an amount of product from a pressurized can having a nozzle which dispenses product when the nozzle is tilted relative to the can, comprising: a dispenser housing for holding a pressurized dispenser can; a sensor which senses the presence of a user's hands near the dispenser housing; and an actuator assembly which tilts the nozzle on the can in response to detecting the user's hands, whereby an amount of product from the can is dispensed in a touch-free manner.

The invention provides a method of dispensing an amount of product from a pressurized can having a dispensing nozzle, comprising: providing a dispenser which holds a can of pressurized product; sensing the presence of a user's hands near the nozzle; and activating an actuating mechanism which tilts the nozzle on the can in response to sensing a user's hands, to thereby dispense product from the can.

DETAILED DESCRIPTION OF THE PREFERRED EMBODIMENT

Figure 1:
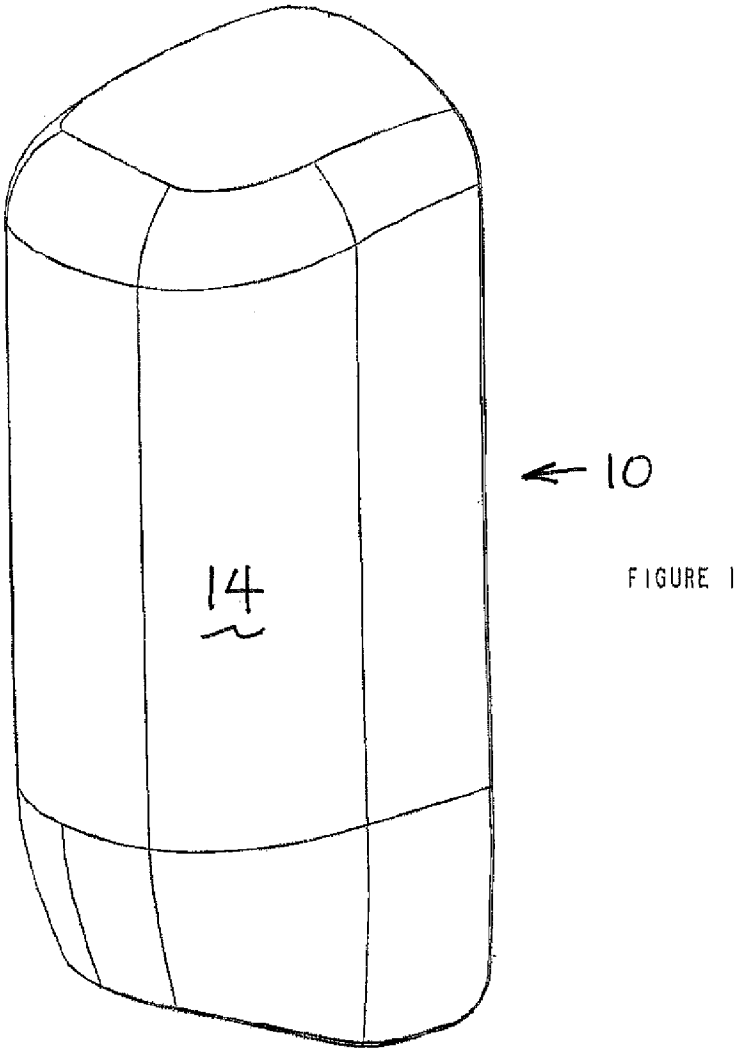
FIG. 1 shows a perspective view of a pressurized can dispenser according to the invention, with the dispenser cover in a closed position.

A preferred embodiment according to one way of practicing the invention will be described, but the invention is not limited to this embodiment.

The invention provides a dispenser for automatically dispensing an amount of product from a pressurized can having a nozzle which dispenses product when the nozzle is tilted relative to the can, comprising: a dispenser housing for holding a pressurized dispenser can; a sensor which senses the presence of a user's hands near the dispenser housing; and an actuator assembly which tilts the nozzle on the can in response to detecting the user's hands, whereby an amount of product from the can is dispensed in a touch-free manner.

The sensor may comprise an infrared sensor. The actuator assembly may comprise a motor and an actuator lever, and wherein the motor, when actuated, moves the actuator lever to tilt the can nozzle. The actuator assembly may include a gear arrangement which rotates an eccentrically arranged actuator knob when the motor is energized, and wherein the actuator lever has an opening which receives the actuator knob, and moves the actuator lever to tilt the can nozzle when the motor in energized to cause the actuator knob to move within the opening. The actuator lever may have an elongated circular profile which fits in the elongated circle opening. The actuator lever may be mounted at a pivot point at one end to the dispenser housing and wherein the actuator lever has an actuator surface at the other end of the actuator lever which contacts the can nozzle when the actuator lever pivots in a first pivot dispensing position to thereby actuate the can nozzle, and a second pivot non-dispensing position wherein actuator surface does not actuate the can nozzle. The dispenser may include a time selection switch having selectable positions which control the amount of time the nozzle is tilted to thereby dispense a selectable volume of product, in response to detection of a user's hands. The selection switch position may determine the amount of time the nozzle is tilted in a single dispensing position. The selection switch position may determine the number of repeated times the nozzle is tilted to dispense a single dosage of product. The dispenser may further comprise a microprocessor connected to the sensor and connected to control the actuator assembly. The dispenser may further comprise a user-settable switch to adjust the sensing range of the sensor. The motor may comprise a DC motor. The dispenser may further include a display which displays status information from the group consisting of dosages dispensed, dosages remaining, identity of user, number of dispensing for a particular user, and expected time for can to be empty. The dispenser may include an expansion port connected to the microprocessor, wherein the microprocessor has associated memory to store usage information, and communicates the information to the expansion port for use by a monitoring unit.

The invention provides a method of dispensing an amount of product from a pressurized can having a dispensing nozzle, comprising: providing a dispenser which holds a can of pressurized product; sensing the presence of a user's hands near the nozzle; and activating an actuating mechanism which tilts the nozzle on the can in response to sensing a user's hands, to thereby dispense product from the can.

The step of activating may comprise tilting the nozzle a plurality of times in response to a single sensing of a user's hands. The method may further include displaying information on a display on the dispenser relating to the dispensing operations, identity of user, frequency of dosing to user, and expected time for can to be empty.

FIG. 1 shows a dispenser 10 according to the invention, adapted to be easily mounted or affixed to a wall. The dispenser 10 has a housing 12 and a retractable, pivoting cover 14.

Figure 2:
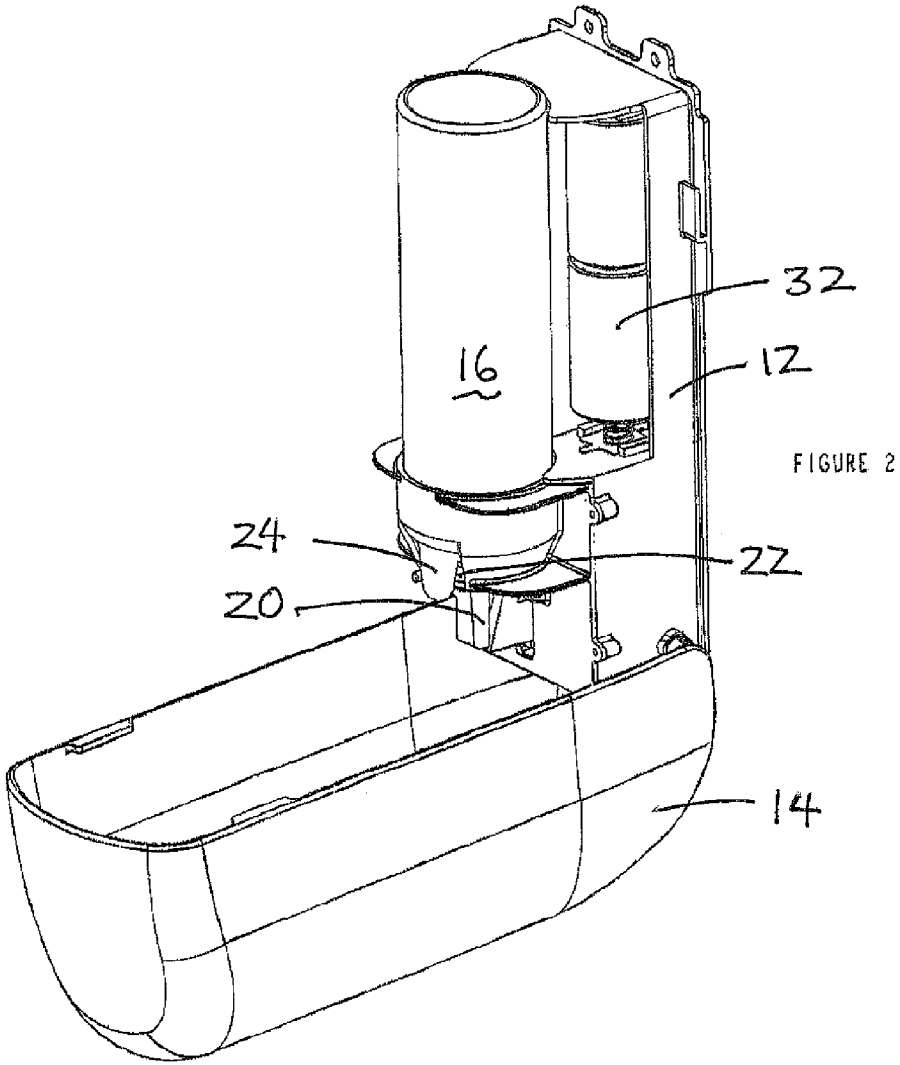
FIG. 2 shows a perspective view like that in FIG. 1, except with the dispenser cover lowered in an open or service position.

FIG. 2 shows the same dispenser 10 with the cover 14 pivoted downward to expose a can or cartridge 16 for removal and replacement, or for other servicing of the dispenser. The can 16 has a nozzle 20 which is normally in the aligned neutral unactuated position aligned with the central axis of the can. To actuate dispensing, the nozzle is tilted with respect to the aligned neutral position by an actuator, as will be explained below. The housing 12 defines a conical can receiving region 23 to accept the can and hold it in a fixed position. The can has a ring 22 at its neck, which is held in place by a spring lock 24, the inside of which has a rib to lock onto the can ring and hold the can in a fixed position.

The underside of the housing 12 has an infrared detector 70 (not shown) to detect the presence of a user's hands to effect dose dispensing from the can. Instead of, or in addition to an infrared detector, other detector types may be used, such as an ultrasonic transmitter and receiver.

Figure 3:
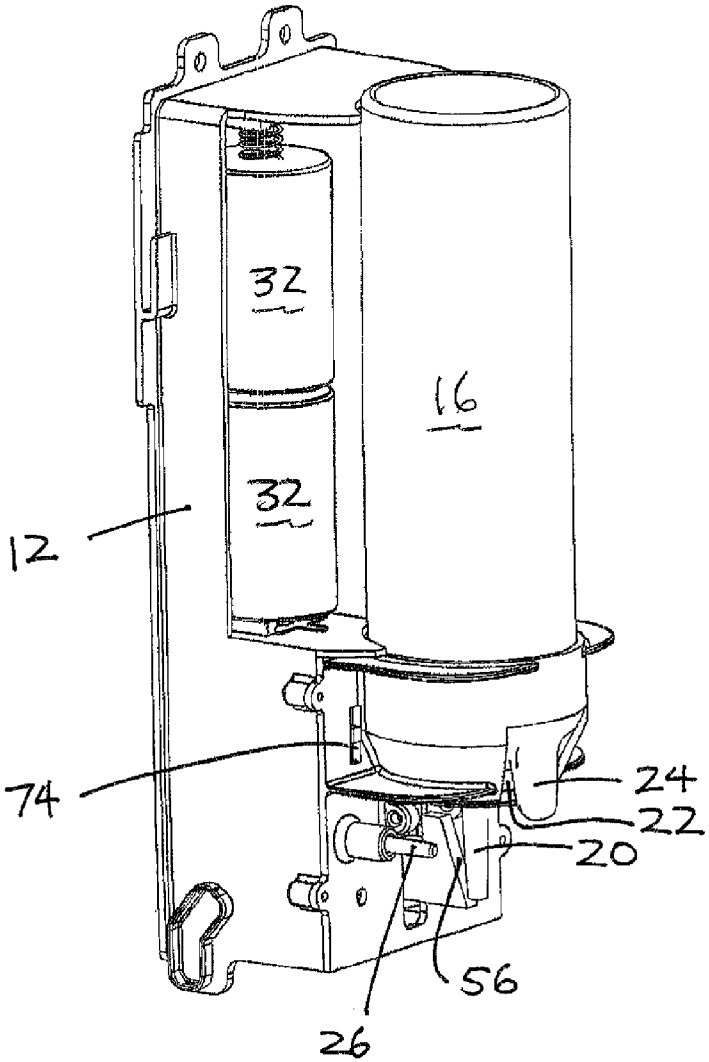
FIG. 3 shows a perspective view of the dispenser with the cover entirely removed.

FIG. 3 shows the dispenser with the cover 14 entirely removed. In this Figure, spring-loaded plunger 26 is shown in the fully-extended position. When the cover is completely on, plunger 26 is depressed by the cover, which activates a lock-out switch 84 to enable normal operation. This prevents dispensing when the cover is not fully on.

Figure 4:
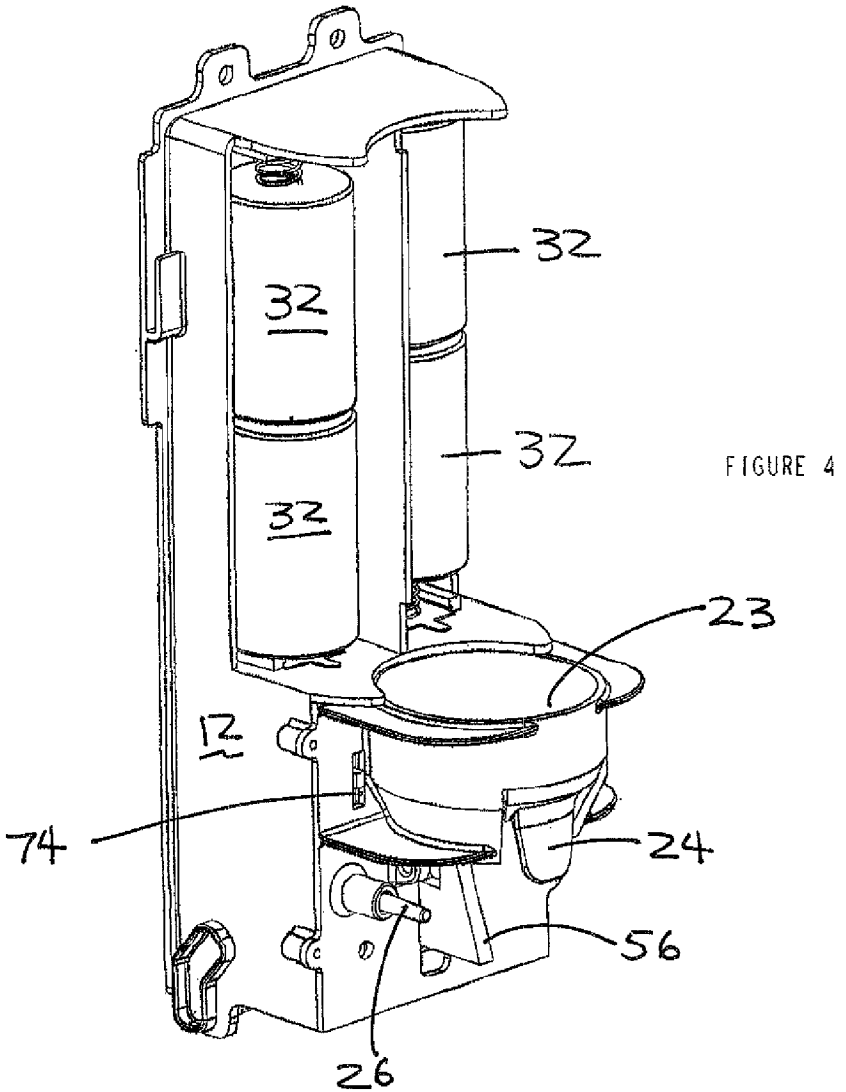
FIG. 4 shows a perspective view of the dispenser like that of FIG. 3, but with the can dispenser removed.

FIG. 4 shows the dispenser with the container removed, but otherwise like FIG. 3. In this Figure, the conical can receiving region 23 is more clearly seen.

Figure 5:
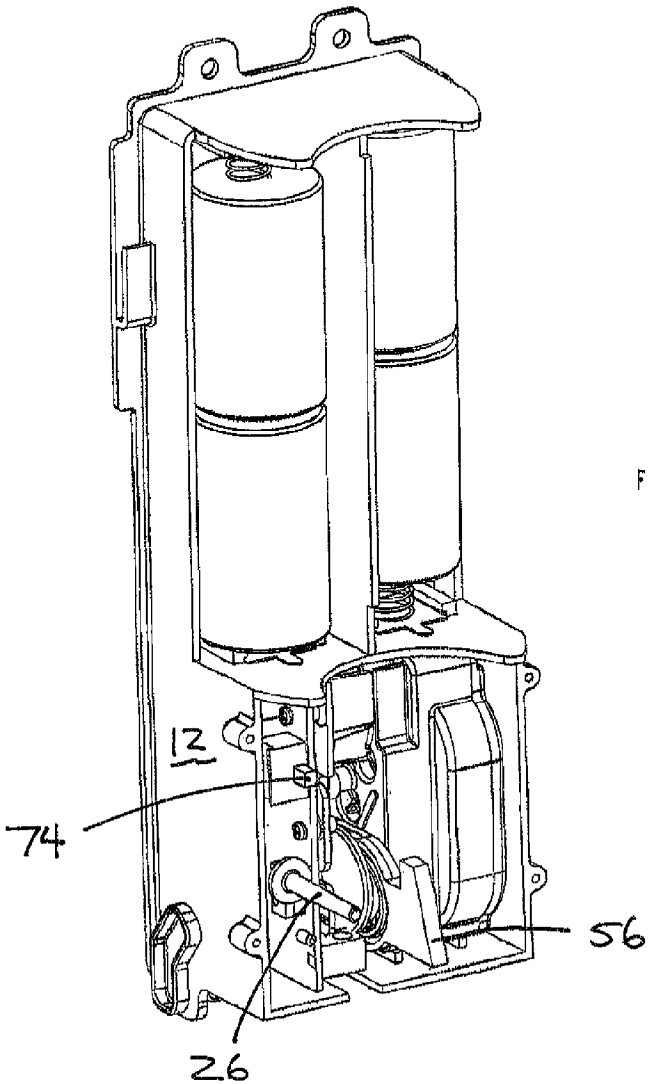
FIG. 5 shows a perspective view of the dispenser like that of FIG. 4, but with a lower cover removed to show internal mechanisms.

FIG. 5 shows the dispenser with the lower cover removed to show the internal mechanisms and how they fit into the dispenser.

Figure 6:
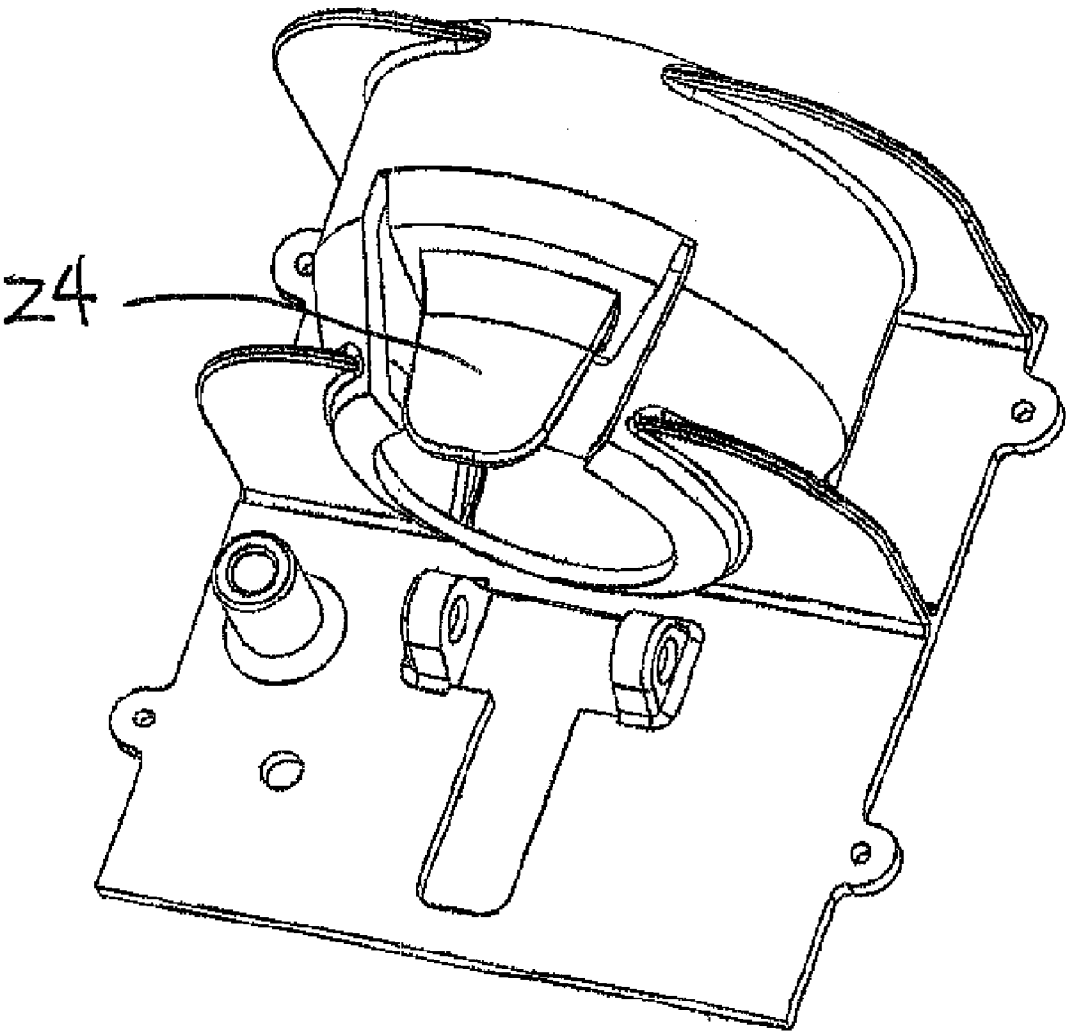
FIG. 6 is a perspective view of the lower cover.

FIG. 6 shows the lower cover alone, with the conical can receiving region.

Figure 7:
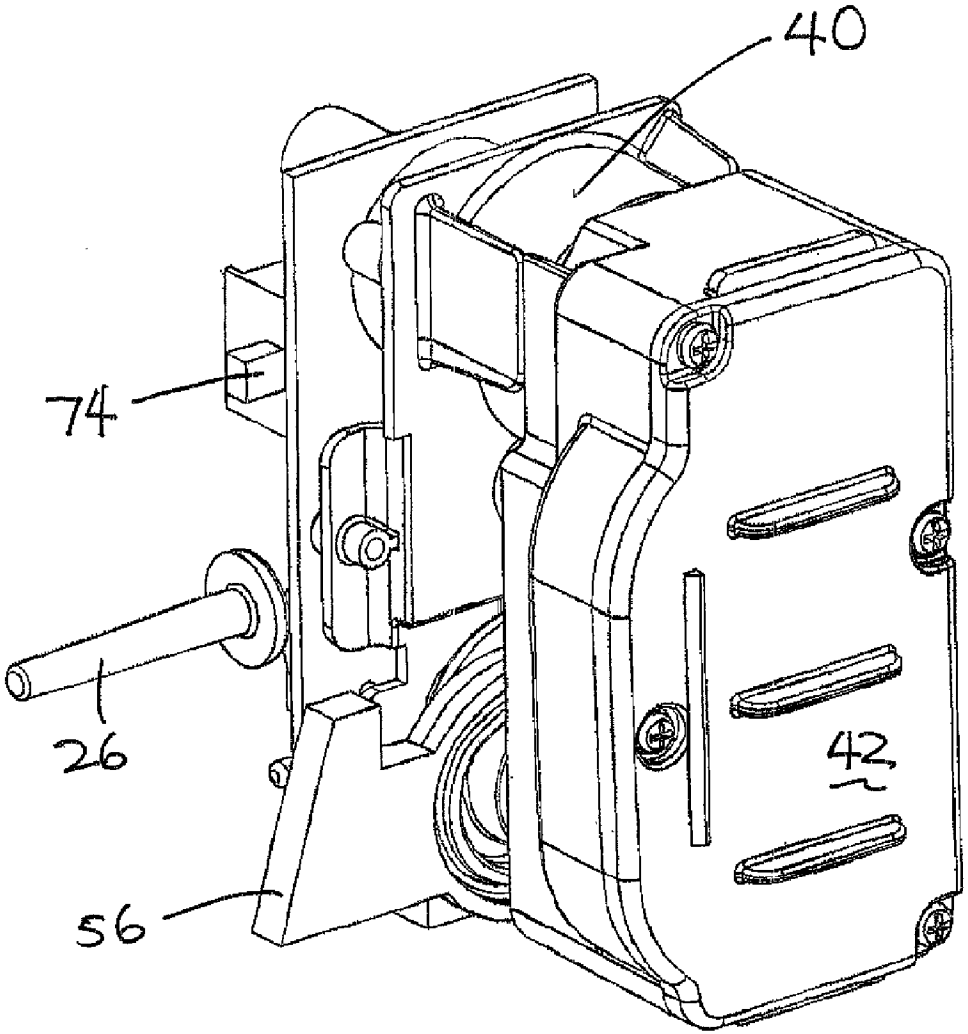
FIG. 7 shows a perspective view of the internal mechanism of the dispenser.

FIG. 7 shows the internal mechanism, including a motor 40, and gearbox 42, which has a gear-down assembly of multiple gears.

Figure 8:
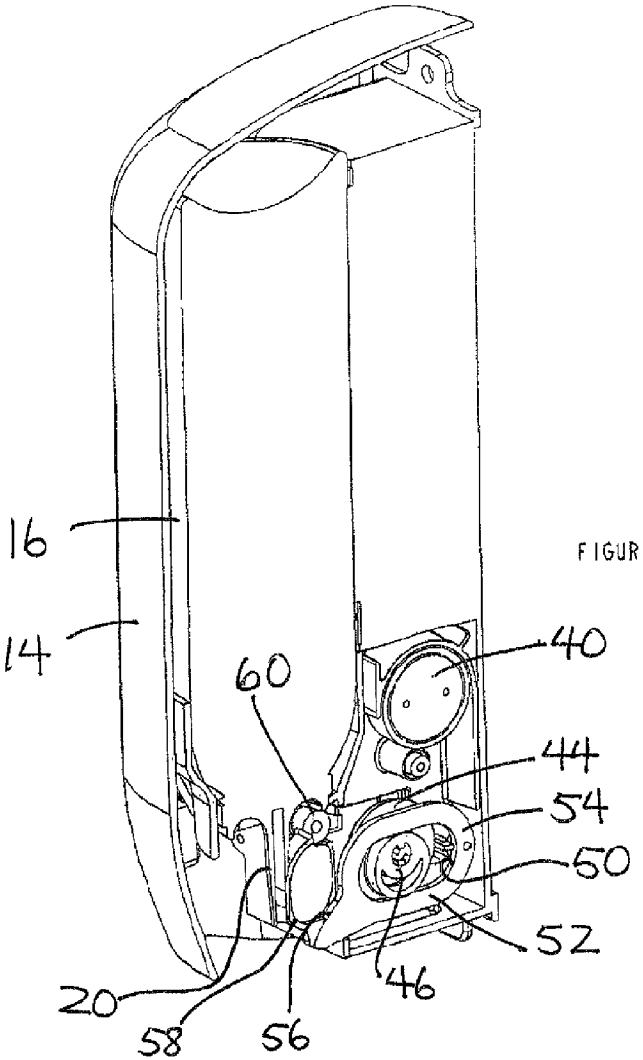
FIG. 8 shows a perspective view like that in FIG. 2, but partially in a cross-section to show the motor, and actuator assembly.

FIG. 8 shows a partial cut-away view of the dispenser to show a battery bay for accepting 4 D-cell batteries 32, although AC power could be supplied in lieu of, or in addition to, the battery supply, with possibly a transformer 64 and bridge circuit 66 to supply DC voltage. It can also be designed to accept low voltage DC power directly from an external wall mounted transformer 65 or other external DC power source 62. A voltage light could be provided to indicate that battery or power supply is sufficient. A low battery indicator 68 could also be provided.

FIG. 8 also shows a motor 40, such as a DC motor. A gear box 42 connects the motor to a rotating wheel 44 which has a cam 46 eccentrically mounted on the wheel. The arrangement of FIG. 8 to engage the nozzle is a variation of the embodiment in the other Figures, in that the inclined surface engages the nozzle indirectly instead of directly. In FIG. 8, the inclined surface engages a pivoting actuator 58 which pivots on pin 60, which actuator 58 engages the nozzle 20 directly.

The cam 46 is received in an elongated opening 50 in an actuating lever 52. One end of the actuating lever 52 is pivotally mounted at point 54 to the housing. The other end of the lever 52 has an inclined surface 56. When the motor 40 is energized, the wheel 44 rotates, and cam 46 causes the lever 52 to pivot about mounting point 54.

When the motor 40 is at rest, the lever 52 does not actuate the nozzle. The motor 40 can be arranged to rotate the wheel 44 through one revolution, to effect one dose to be dispensed from can 16. The motor can be geared or otherwise arranged to go at a certain speed through that single revolution of wheel 44 to dispense a certain unit dose.

The actuating mechanism provides a user configurable dose, activation range, and motor speed settings. The dose may be set by selecting 1, 2, or 3, via switch 74. Increasing the dose setting will increase the number of revolutions the cam will make and thus increase the number of pre-measured doses expelled from the can by the dispenser. The default dose setting is 1. Activation range can be selectable by sensor range switch 72 to be long, medium, or short, with long-range activation occurring at a maximum human hand range of 2 to 4 inches. The range may be configurable via a jumper located on the back of the actuating mechanism. The default setting is long-range. Motor speed can be selected by switch 75 to be fast or slow. Fast is the default setting, and will produce a pre-measured volume of product output. Slow will cause the cam to engage the can's nozzle for a longer period of time, and thus produce a greater pre-measured volume of product.

The actuating mechanism may be powered by four D-cell batteries. The current required to activate the can nozzle will be minimal compared to other available foam or lotion dispenser cartridge combinations. Battery life could exceed 2 years with a usage of 100 activations per day. The actuating mechanism may include an expansion port that will allow the dispenser to be integrated into a hand wash or sanitization monitoring system.

Figure 9:
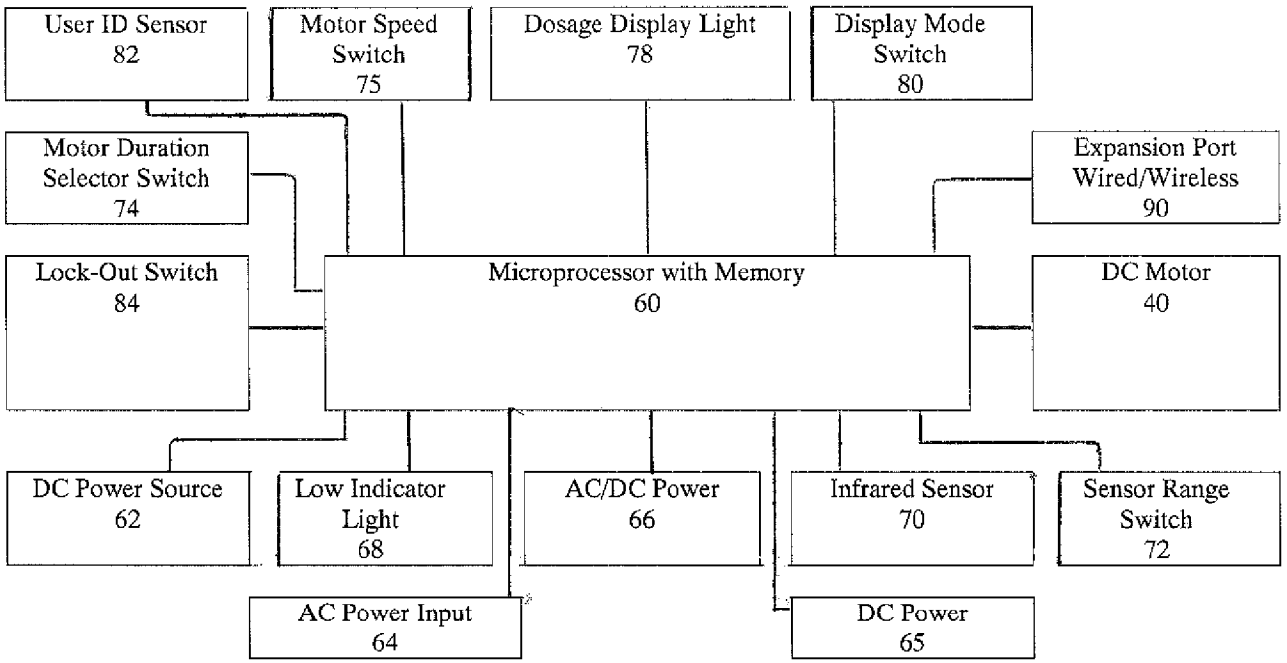
FIG. 9 is a block diagram schematic of the electrical components of the dispenser.

FIG. 9 shows a block diagram of the electrical and control elements of the system. FIG. 4 shows a microprocessor 60 (with program memory) which is powered by DC power source 62, and/or by AC power input 64, including a transformer and AC/DC converter 66, such as a rectifier bridge circuit, or by DC power source 65. A low-power light 68 indicates when battery power is low for replacement of the batteries.

An infrared sensor 70 detects the presence of a user's hands, and a sensor range switch 72 provides different settings for different ranges, such as short-range, long-range, or medium-range.

The microprocessor 60 is connected to the DC motor 40, and is also connected to a motor duration switch 74 whereby a user can select the period of time that the motor is powered on for each detection by sensor 70, to control the dose amount of product dispensed, A dosage count display or low dosage indicator light/LED 78 can provide a count or indication of the dosages dispensed or remaining in the can, so that expected can replacement times can be monitored to provide an indication of when the can may need to be replaced, as well as how often people are dispensing product according to hygiene practices.

The display can be arranged to display the expected time that the can will be empty, based on the capacity of the can and the rate at which the dispensings are occurring. This display mode could be entered by pressing display mode switch 80, which switch can also control other display modes by cycling through the modes with switch depressions.

A user identification sensor 82 can provide the identity of the users, by detecting a user's unique badge by RFID or other means, to keep track of how often, and the times at which particular users are washing their hands. When a particular user is detected, the microprocessor can jump to a count mode to provide a daily (weekly or other time period) count to the display 78 or the number of times that day (or other period) that the user has washed his or her hands, and can also provide a time display of how long since the user last washed his or her hands. Compliance data for each user can be stored in memory associated with the microprocessor.

The systems can also provide customized range, dosage, and/or other settings for certain users or classes of users, after detection of the particular user. For example, some users may wish more product to be dispensed, and/or their hand to be detected at certain range. Once the system detects the identity of the user, those customized settings, previously stored, can replace or over-ride the settings selected by the switches.

The microprocessor 60 can be connected to an expansion port 90 to provide a wired or wireless communication to another device, such as a master controller, monitoring unit, or compliance control center.

Although one embodiment has been described, the invention is not limited to the embodiment, and the scope of the invention is defined by the claims and equivalents.

The invention claimed is:

1. A dispenser for automatically dispensing an amount of product from a pressurized can having a nozzle which dispenses product when the nozzle is tilted from its normal vertical straight up position relative to the can, comprising:

a dispenser housing for holding a pressurized dispenser can in an upside-down position;

a sensor which senses the presence of a user's hands beneath the dispenser housing;

an actuator assembly which tilts the nozzle on the can in response to detecting the user's hands, wherein the actuator assembly comprises a motor and an actuator lever, and wherein the actuator assembly includes an eccentrically arranged actuator knob which rotates eccentrically when the motor is energized, and wherein the actuator lever has an elongated circular profile opening which receives the eccentrically arranged actuator knob, and moves the actuator lever to tilt the can nozzle, wherein the actuator lever is mounted at a pivot point at one end to the dispenser housing and wherein the actuator lever has an actuator surface at the other end of the actuator lever which contacts the can nozzle when the actuator lever pivots between a first pivot dispensing position to thereby actuate the can nozzle, and a second pivot non-dispensing position wherein the actuator surface does not actuate the can nozzle, whereby an amount of product from the can is dispensed in a touch-free manner.

2. The dispenser of claim 1, wherein the sensor comprises an infrared sensor.

3. The dispenser of claim 1, comprising a time selection switch having selectable positions which control the amount of time the nozzle is tilted to thereby dispense a selectable volume of product, in response to a single detection of a user's hands.

4. The dispenser of claim 3, wherein the selection switch position determines the amount of time the nozzle is tilted in a single dispensing position.

5. The dispenser of claim 3, wherein the selection switch position determines the number of repeated times the nozzle is tilted to dispense a single dosage of product.

6. The dispenser of claim 1, further comprising a microprocessor connected to the sensor and connected to control the actuator assembly.

7. The dispenser of claim 1, further comprising a user-settable switch to adjust the sensing range of the sensor.

8. The dispenser of claim 1, wherein the motor comprises a stepper motor.

9. The dispenser of claim 1, further including a display which displays status information from the group consisting of dosages dispensed, dosages remaining, identity of user, number of dispensing for a particular user, expected time for can to empty.

10. The dispenser of claim 6, including an expansion port connected to the microprocessor, wherein the microprocessor has associated memory to store usage information, and communicates the information to the expansion port for use by a monitoring unit.

11. A method of dispensing an amount of product from a pressurized can having a dispensing nozzle, comprising:

providing a dispenser housing which holds a can of pressurized product in an upside-down position with the dispensing nozzle faced downward;

sensing the presence of a user's hands near the nozzle;

activating an actuating mechanism which rotates an eccentrically arranged actuator knob within an elongated circular profile opening in an actuator lever which tilts the nozzle on the can in response to sensing a user's hands, wherein the actuator lever is mounted at a pivot point at one end to the dispenser housing and wherein the actuator lever has an actuator surface at the other end of the actuator lever which contacts the can nozzle when the actuator lever pivots between a first pivot dispensing position to thereby actuate the can nozzle, and a second pivot non-dispensing position wherein the actuator surface does not actuate the can nozzle, to thereby dispense product from the can.

12. The method of claim 11, wherein the step of activating comprises tilting the nozzle a plurality of times in response to a single sensing of a user's hands.

13. The method of claim 11, further including displaying information on a display on the dispenser relating to the dispensing operations, identity of user, frequency of dosing to user, and expected time for can to empty.

14. A dispenser for automatically dispensing an amount of product from a pressurized can having a nozzle which dispenses product when the nozzle is tilted from its normal vertical straight up position relative to the can, comprising:

a dispenser housing for holding a pressurized dispenser can in an upside-down position;

a sensor which senses the presence of a user's hands beneath the dispenser housing;

an actuator assembly which tilts the nozzle on the can in response to detecting the user's hands, the actuator assembly including an actuator lever;

and wherein the actuator assembly includes an eccentrically arranged actuator knob which rotates eccentrically, and wherein the actuator lever has an elongated circular profile opening which receives the eccentrically arranged actuator knob, wherein the actuator lever is mounted at a pivot point at one end to the dispenser housing and wherein the actuator lever has an actuator surface at the other end of the actuator lever which contacts the can nozzle when the actuator lever pivots between a first pivot dispensing position to thereby actuate the can nozzle, and a second pivot non-dispensing position wherein the actuator surface does not actuate the can nozzle whereby an amount of product from the can is dispensed in a touch-free manner.

* * * * *